US009193561B2

(12) United States Patent
Yan et al.

(10) Patent No.: US 9,193,561 B2
(45) Date of Patent: Nov. 24, 2015

(54) CABLE MANAGEMENT DEVICE

(71) Applicants: AMBIT MICROSYSTEMS (SHANGHAI) LTD., Shanghai (CN); HON HAI PRECISION INDUSTRY CO., LTD., New Taipei (TW)

(72) Inventors: Jun Yan, Shanghai (CN); Yan-Hua He, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 181 days.

(21) Appl. No.: 14/037,389

(22) Filed: Sep. 26, 2013

(65) Prior Publication Data

US 2014/0239109 A1 Aug. 28, 2014

(30) Foreign Application Priority Data

Feb. 26, 2013 (CN) ..... 2013 1 0059222

(51) Int. Cl.
*B65H 75/48* (2006.01)
*B65H 75/40* (2006.01)
*B65H 75/44* (2006.01)

(52) U.S. Cl.
CPC ..... *B65H 75/406* (2013.01); *B65H 75/4423* (2013.01); *B65H 2701/537* (2013.01)

(58) Field of Classification Search
CPC .. B65H 75/48; B65H 75/406; B65H 75/4418; B65H 75/4423
USPC ..... 242/378, 378.1–378.4
See application file for complete search history.

(56) References Cited

U.S. PATENT DOCUMENTS

| | | | | |
|---|---|---|---|---|
| 7,367,522 | B2 * | 5/2008 | Chen | 242/378.1 |
| 7,494,083 | B1 * | 2/2009 | Yen | 242/378.1 |
| 7,900,670 | B2 * | 3/2011 | McCauley et al. | 152/219 |
| 8,245,371 | B2 * | 8/2012 | Chen | 24/712.9 |
| 8,870,111 | B2 * | 10/2014 | Kwankijpongsa et al. | 242/378 |
| 8,967,518 | B2 * | 3/2015 | Guo | 242/378 |
| 8,973,857 | B2 * | 3/2015 | Moore | 242/378 |

(Continued)

FOREIGN PATENT DOCUMENTS

| | | |
|---|---|---|
| CN | 201985402 U | 9/2011 |
| TW | 468667 | 12/2001 |
| TW | M253589 | 12/2004 |

(Continued)

*Primary Examiner* — Sang Kim
(74) *Attorney, Agent, or Firm* — Novak Druce Connolly Bove + Quigg LLP

(57) ABSTRACT

A cable management device includes a base, a locking member, a winding member, a driving member, a pressing member, and a spring. The base comprises a bottom board and a guide member. The locking member includes a pedestal and a sleeve. The winding member includes a winding portion sandwiched between a first end and a second end. The winding member defines a first receiving hole for receiving the sleeve. A number of first sawteeth formed on the pedestal mesh with a number of second sawteeth formed on the first end. The driving member includes a plate and a second receiving hole passing through the plate for receiving the sleeve. A number of third sawteeth formed on the second end mesh with a number of fourth sawteeth formed on the plate. The pressing member is connected to the sleeve. The spring is compressed between the pressing member and the driving member.

14 Claims, 9 Drawing Sheets

(56) References Cited

U.S. PATENT DOCUMENTS

| | | | | |
|---|---|---|---|---|
| 2004/0129820 | A1* | 7/2004 | Liao | 242/378.1 |
| 2008/0064262 | A1 | 3/2008 | Wu | |

FOREIGN PATENT DOCUMENTS

| | | |
|---|---|---|
| TW | M433397 U1 | 7/2012 |
| TW | M445007 U1 | 1/2013 |

* cited by examiner

CABLE MANAGEMENT DEVICE

BACKGROUND

1. Technical Field

The present disclosure relates to a cable management device for winding a cable, wire or similar.

2. Description of Related Art

FIG. 9 shows a bunching device 2 which is used to gather and secure together a number of wires 9. The bunching device 2 includes a cable tie 4 and a buckle 6. One end of the cable tie 4 is fixedly connected to the buckle 6, and the other end passes through the buckle 6 and is adjustably connected to the buckle 6. Thereby, a binding ring 8 is formed. When in use, the wires 9 extend through the binding ring 8, and the cable tie 4 is pulled relative to the buckle 6 to bunch the wires 9. However, the bunching device 2 can only bunch the wires 9, and the cable tie 4 must be cut to release the wires 9. Therefore, the bunching device 2 cannot be reused. This is inconvenient and costly.

Therefore, it is desirable to provide a cable management device which can overcome or at least alleviate the above-mentioned problems.

DETAILED DESCRIPTION

Figure 1:
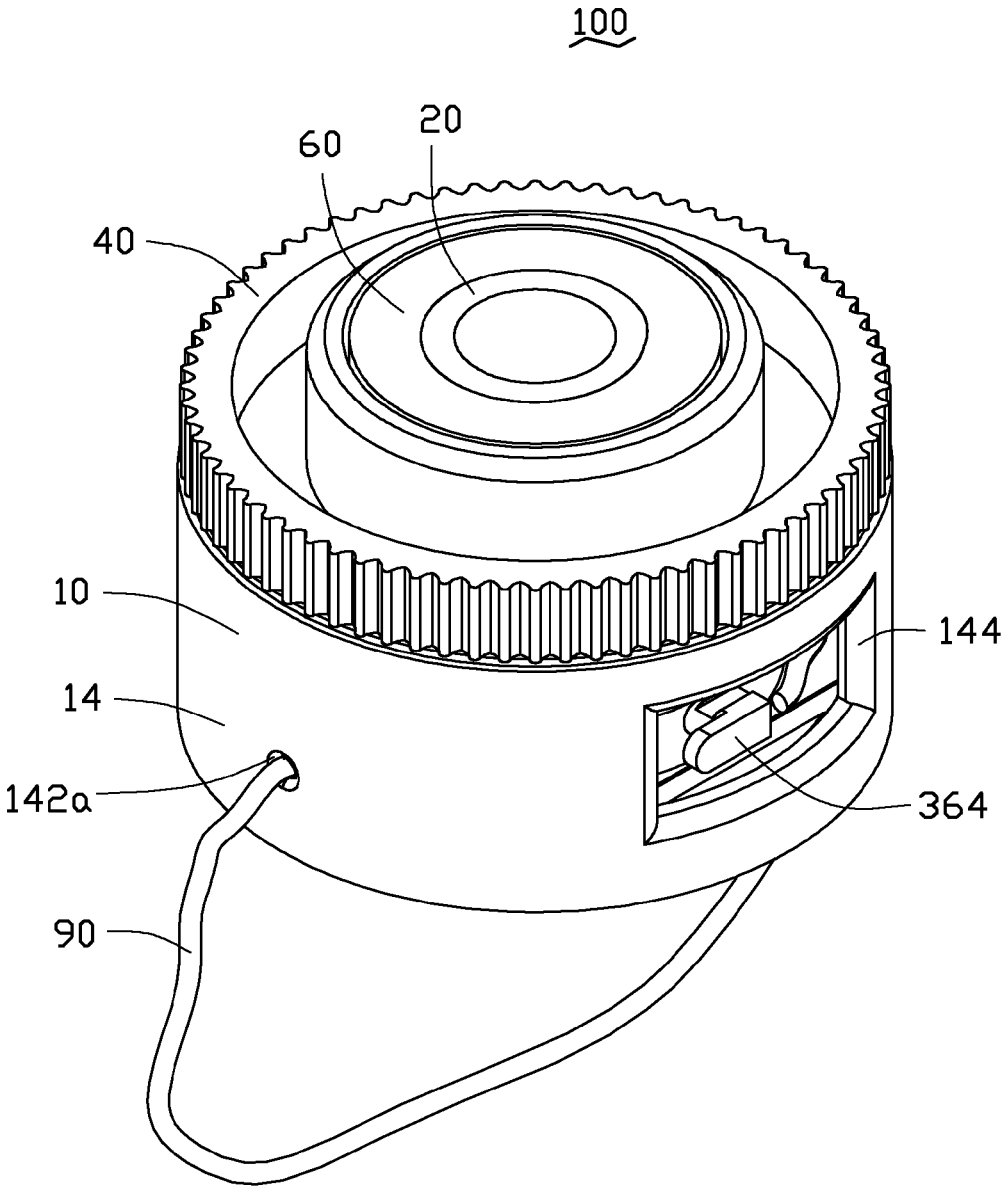
FIG. 1 is a schematic, isometric view of a cable management device according to an exemplary embodiment, the cable management device including a locking member, a winding member and a blocking member, and also showing a cable.
Figure 2:
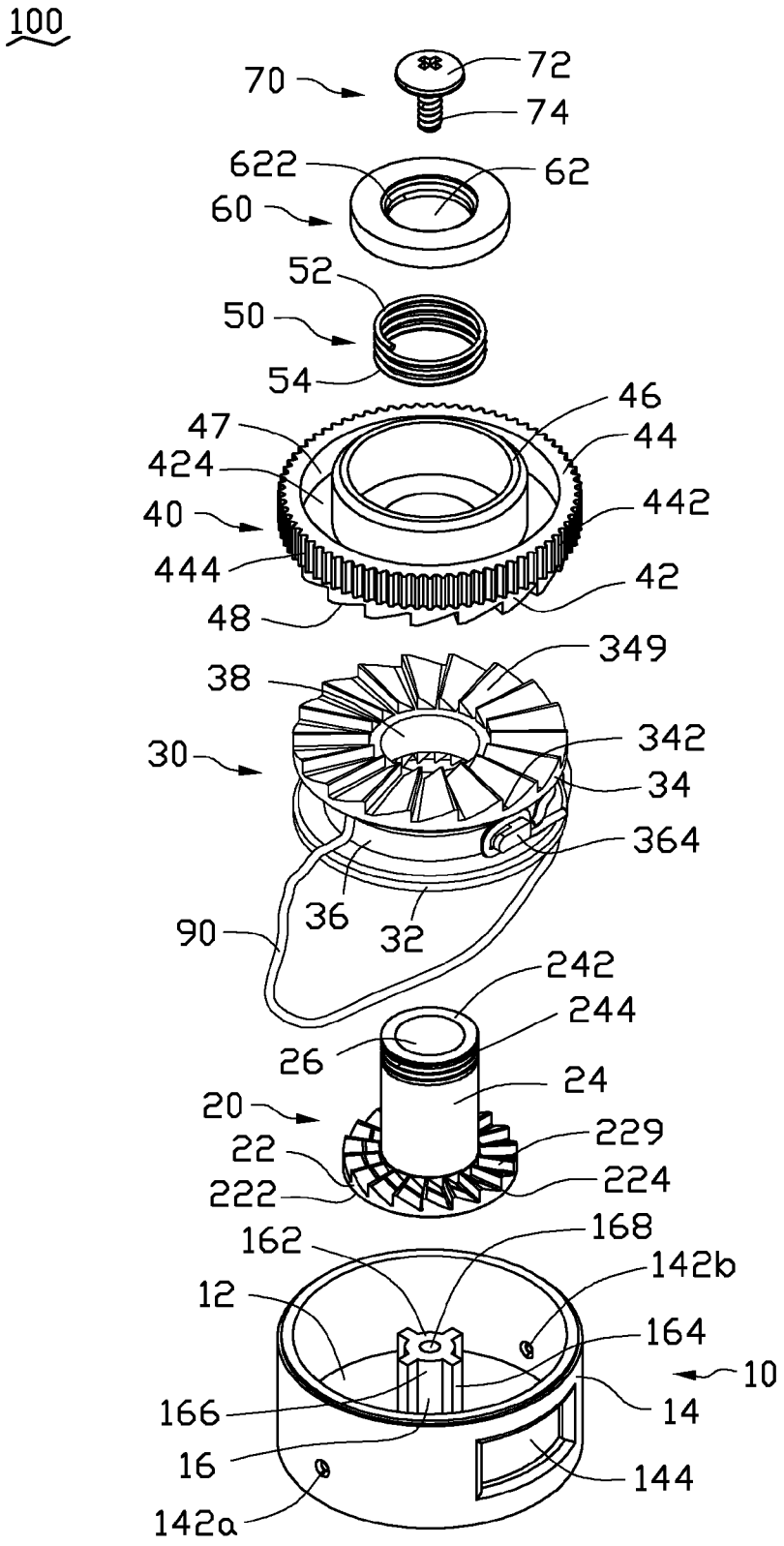
FIG. 2 is an exploded view of the cable management device and cable of FIG. 1.
Figure 3:
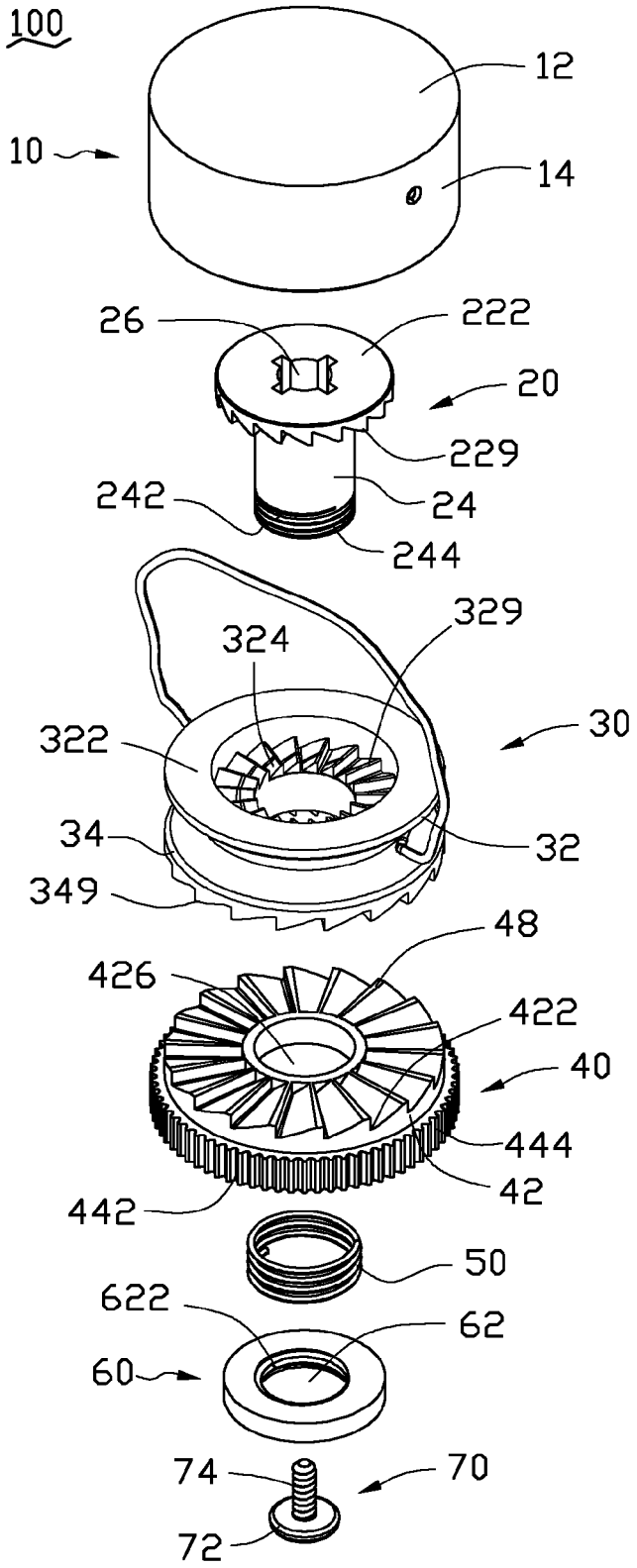
FIG. 3 is similar to FIG. 2, but showing the cable management device and cable inverted.
Figure 4:
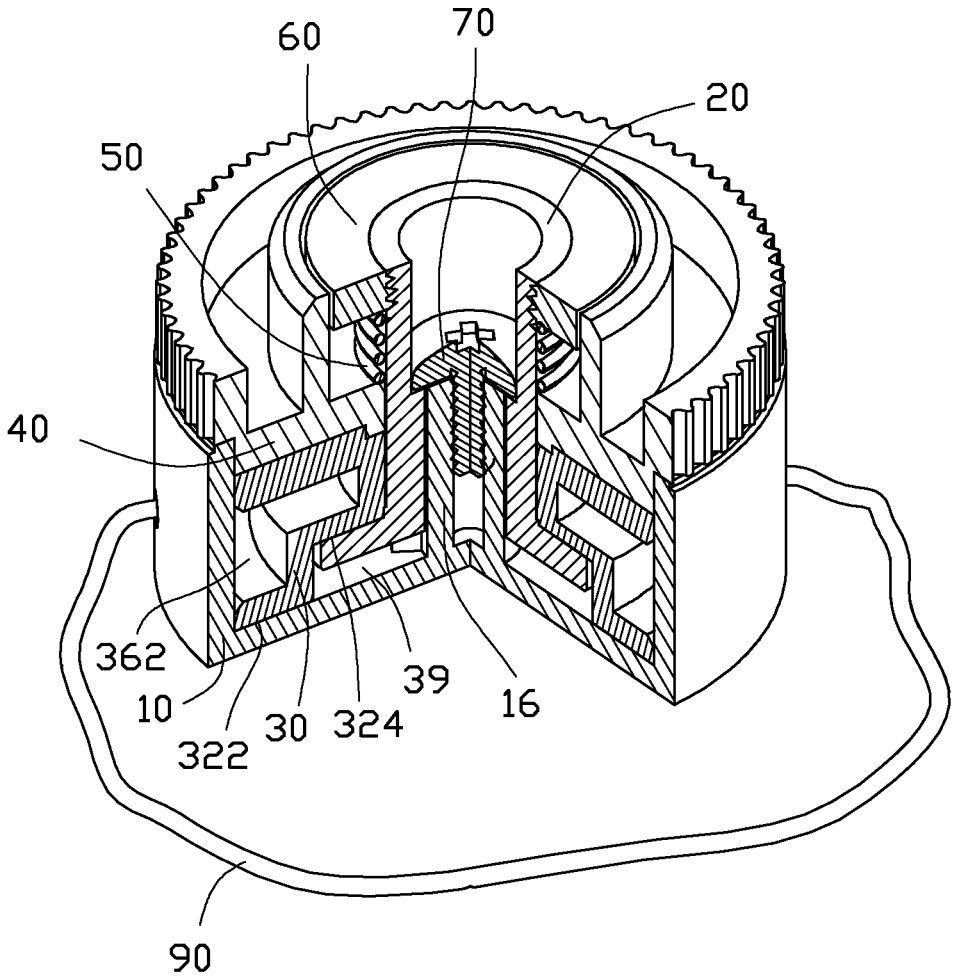
FIG. 4 is essentially a cutaway view of the cable management device of FIG. 1, wherein the winding member is in contact with the locking member.

FIGS. 1-3 show a cable management device 100 according to an exemplary embodiment. The cable management device 100 includes a base 10, a locking member 20, a winding member 30, a driving member 40, a spring 50, a pressing member 60, and a blocking member 70. The cable management device 100 is substantially a cylinder, and is configured to gather and secure together a cable 90, for example.

The base 10 includes a bottom board 12, a peripheral side wall 14, and a guide member 16. The bottom board 12 is substantially circular. The side wall 14 perpendicularly extends from the bottom board 12 and surrounds the bottom board 12 to form a cylinder. Two through holes 142*a*, 142*b* and an opening 144 are defined in the side wall 14. The two through holes 142*a*, 142*b* are located at diametrically opposite sides of the side wall 14 in this embodiment, and allow the cable 90 to pass through. The opening 144 is substantially rectangular. The guide member 16 perpendicularly extends up from a central portion of the bottom board 12, and is surrounded by the side wall 14. The guide member 16 includes a main body 162 and four elongate, vertical protrusions 164. The main body 162 is substantially a cylindrical rod with a circumferential surface 166. The protrusions 164 extend from the circumferential surface 166. The protrusions 164 perpendicularly connect the bottom board 12. In this embodiment, the protrusions 164 are uniformly distributed around the circumferential surface 166. A blocking hole 168 with internal threads (not labeled) is defined in the main body 162 along a longitudinal direction of the main body 162.

FIGS. 1-3 and 7-8 show that the locking member 20 includes a pedestal 22, and a sleeve 24 perpendicularly extending from a central portion of the pedestal 22.

The pedestal 22 includes a first surface 222 and a second surface 224. The first surface 222 and the second surface 224 are positioned at opposite sides of the pedestal 22. The first surface 222 faces the bottom board 12. A number of first sawteeth 229 are formed on the second surface 224.

The sleeve 24 includes a top end 242 away from the pedestal 22. External threads 244 are formed on an outer wall of the top end 242. A stepped hole 26 is defined in the locking member 20 and axially passes through the sleeve 24 and the pedestal 22. The stepped hole 26 includes a first receiving portion 262 and a second receiving portion 264. The first receiving portion 262 is adjacent to the top end 242, and the second receiving portion 264 is adjacent to the pedestal 22. The inner diameter of the first receiving portion 262 is larger than that of the second receiving portion 264, thereby an engagement surface 266 is formed at the junction of the first receiving portion 262 and the second receiving portion 264. Four vertical grooves 268 are defined in an inner wall of the sleeve 24 at the second receiving portion 264. In detail, the grooves 268 are parallel to a center axis of the locking member 20, and pass through the engagement surface 266 and the first surface 222. The length of each of the grooves 268 is substantially equal to the depth of the second receiving portion 264. The depth of the grooves 268 is less than or equal to the difference between the radius of the first receiving portion 262 and the radius of the second receiving portion 264, and each groove 268 receives a corresponding protrusion 164. In this embodiment, the length of each of the protrusions 164 is larger than the length of each of the grooves 268.

Figure 6:
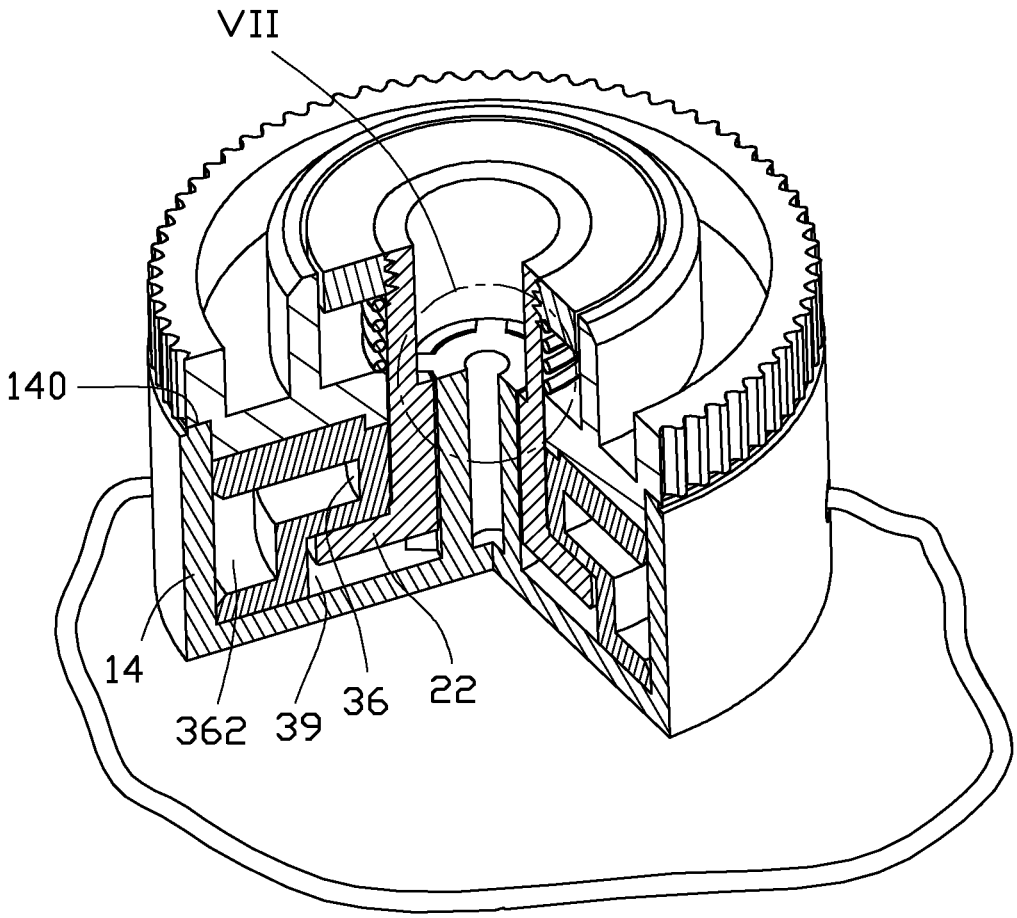
FIG. 6 is similar to FIG. 4, but with the blocking member omitted.
Figure 7:
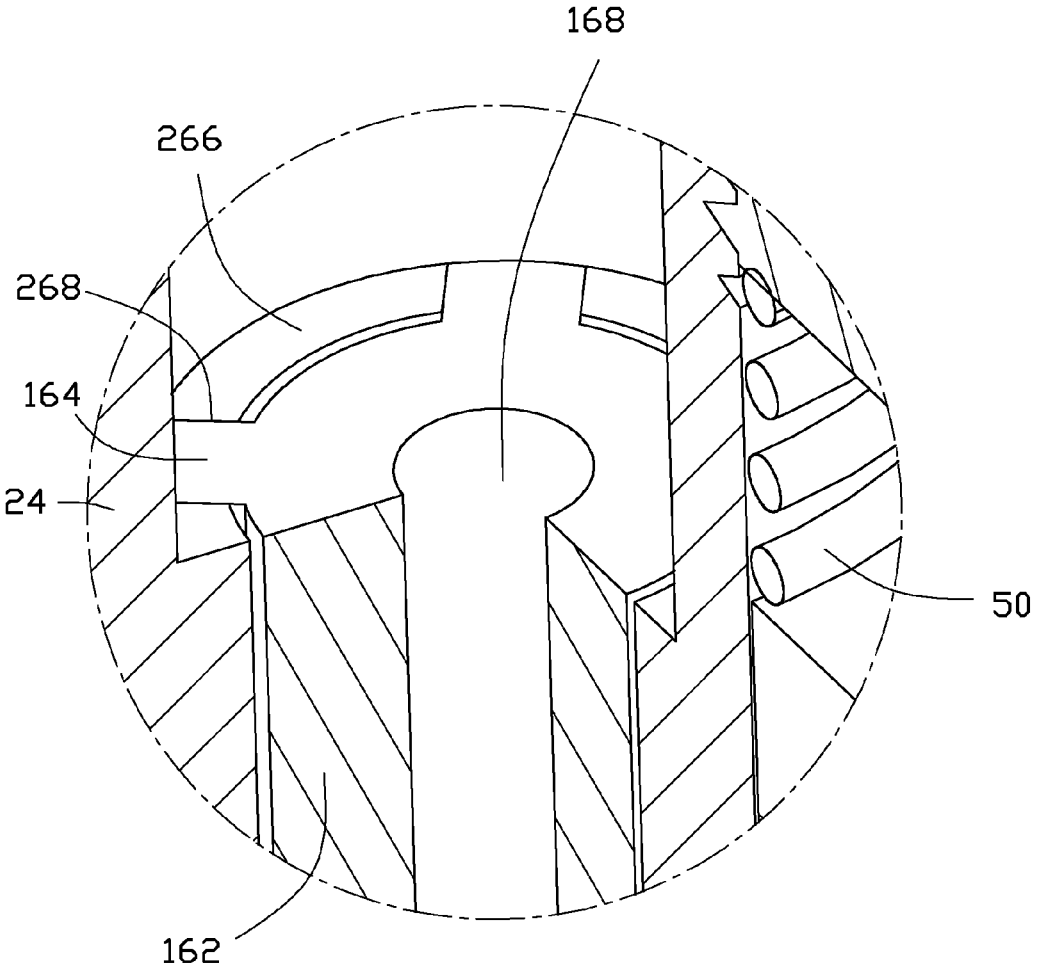
FIG. 7 is an enlarged view of a circled section VII of FIG. 6.
Figure 8:
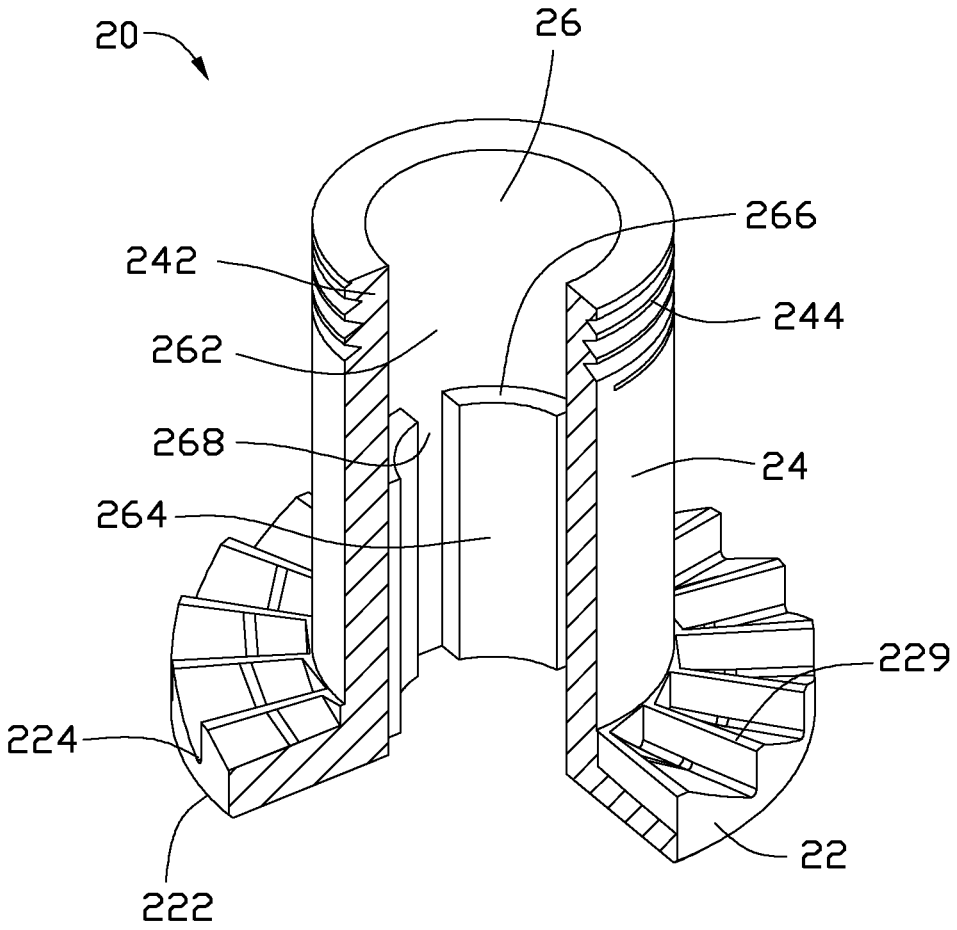
FIG. 8 is a cutaway view of the locking member of FIG. 2.
Figure 9:
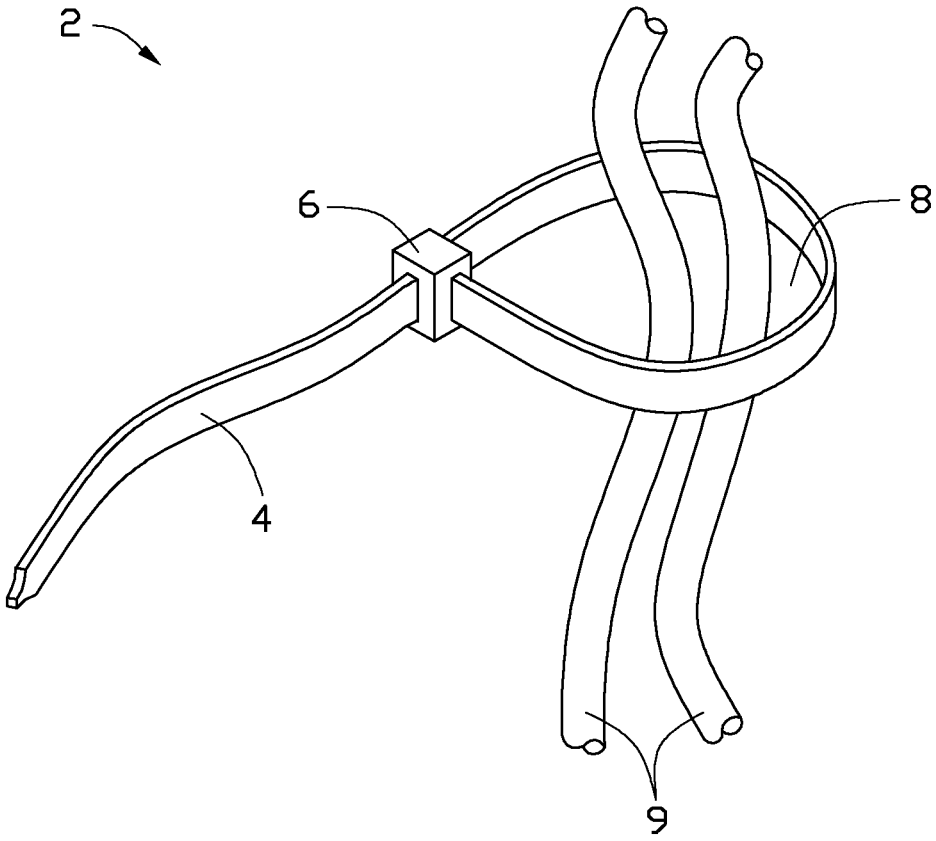
FIG. 9 (RELATED ART)
FIG. 9 is a schematic view of a bunching device of related art, together with a number of wires.

FIGS. 2-3 and 6 show that the winding member 30 includes a first end 32, a second end 34, and a winding portion 36. The first end 32 and the second end 34 are positioned at opposite sides of the winding portion 36. The first end 32, the winding portion 36, and the second end 34 cooperatively form a winding space 362. A first receiving hole 38 is defined in a central portion of the winding member 30. The first receiving hole 38 axially passes through the first end 32, the winding portion 36, and the second end 34. The first receiving hole 38 receives the sleeve 24.

The first end 32 includes a third surface 322 and a fourth surface 324. The third surface 322 and the fourth surface 324 are on the same side of the winding member 30, and are both ring-shaped. The fourth surface 324 surrounds the first receiving hole 38, and the third surface 322 can be considered to surround the fourth surface 324. The fourth surface 324 is recessed relative to the third surface 322. A number of second sawteeth 329 are formed on the fourth surface 324. The second sawteeth 329 mesh with the first sawteeth 229 when the fourth surface 324 is in contact with the second surface 224.

The second end 34 includes a fifth surface 342. The fifth surface 342 and the fourth surface 324 are at the opposite sides of the winding member 30, with the fifth surface 342 being at the second end 34, and the fourth surface 324 being nearer the first end 32. A number of third sawteeth 349 are formed on the fifth surface 342. A hook 364 is formed on the winding portion 36 and is positioned in the winding space 362. The hook 364 hooks the cable 90.

The driving member 40 includes a plate 42, an outer barrel 44, an inner barrel 46 and a number of fourth sawteeth 48.

The plate 42 is substantially circular, and includes a lower surface 422 and an upper surface 424. The lower surface 422 and the upper surface 424 are positioned at opposite sides of the plate 42, and the lower surface 422 is substantially parallel to the upper surface 424. A second receiving hole 426 is axially defined in the plate 42 and extends from the lower surface 422 to the upper surface 424. The second receiving hole 426 is positioned at a central portion of the plate 42.

The outer barrel 44 perpendicularly extends from the upper surface 424 and surrounds the second receiving hole 426. The outer barrel 44 includes an outer side surface 442. A number of knurls 444 are formed on the outer side surface 442.

The inner barrel 46 perpendicularly extends from the upper surface 424. The inner barrel 46 is received in the outer barrel 44 and surrounds the second receiving hole 426. The outer barrel 44, the inner barrel 46, and the plate 42 cooperatively form a ring-shaped groove 47. The height of the inner barrel 46 is larger than that of the outer barrel 44.

Figure 5:
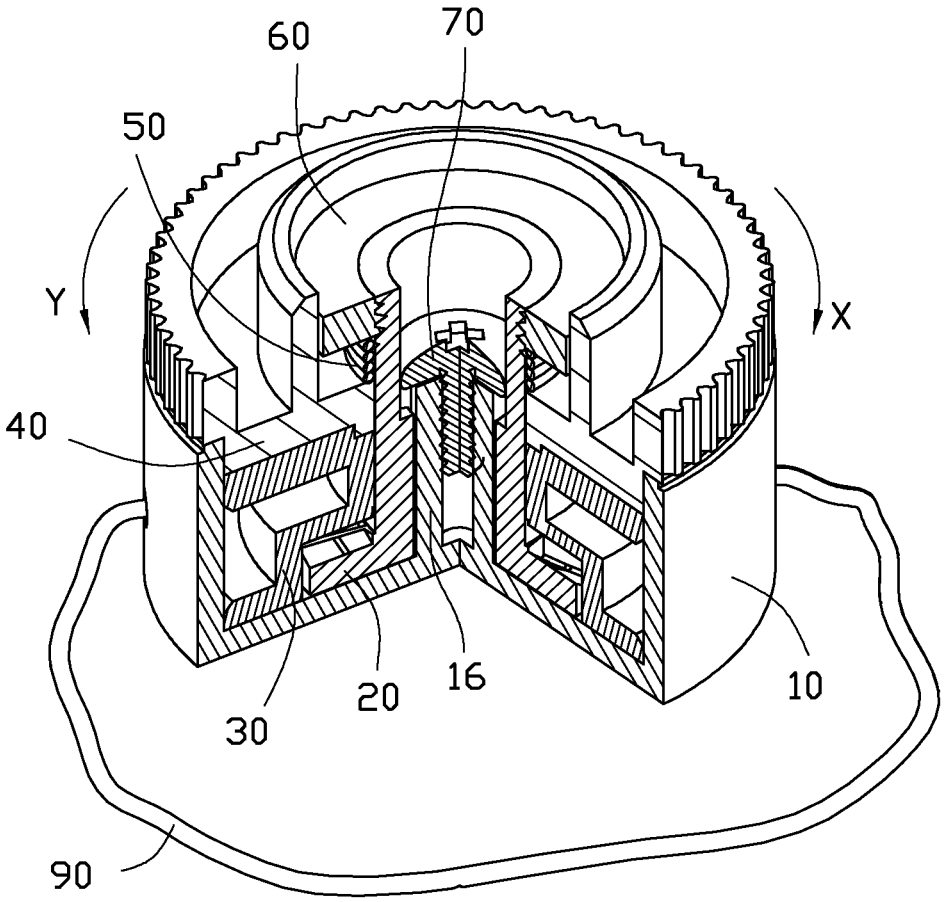
FIG. 5 is similar to FIG. 4, but showing the winding member separated from the locking member.

The fourth sawteeth 48 are formed on the lower surface 422. The fourth sawteeth 48 mesh with the third sawteeth 349. In this embodiment, the first sawteeth 229, the second sawteeth 329, the third sawteeth 349 and the fourth sawteeth 48 are all tilted. That is, each of the first, second, third and fourth sawteeth 229, 329, 349, 48 is non-symmetrical about a vertical centerline of a vertical cross-section thereof. The first sawteeth 229 and the third sawteeth 349 are tilted in two contrary directions, namely a second direction and an opposite first direction, respectively. The second sawteeth 329 and the fourth sawteeth 48 are tilted in two contrary directions, namely the first direction and the second direction, respectively. Thus, the first sawteeth 229 tilted in the second direction mesh with the second sawteeth 329 tilted in the first direction, and the third sawteeth 349 tilted in the first direction mesh with the fourth sawteeth 48 tilted in the second direction. Accordingly, the driving member 40 can rotate the winding member 30 in the second direction, but cannot rotate the winding member 30 in the first direction. In this embodiment, the first direction is counterclockwise (arrow Y shown in FIG. 5), and the second direction is clockwise (arrow X shown in FIG. 5).

The pressing member 60 is substantially ring-shaped. A threaded hole 62 with internal threads 622 is axially defined in a central portion of the pressing member 60, and passes through the pressing member 60. The internal threads 622 engage with the external threads 244.

The spring 50 includes an upper end 52 and a lower end 54. The upper end 52 and the lower end 54 are positioned at opposite top and bottom sides of the spring 50.

The blocking member 70 is typically a bolt, and includes a cap 72 and a rod 74. The cap 72 is substantially circular. The diameter of the cap 72 is larger than the inner diameter of the second receiving portion 264, but is slightly less than the inner diameter of the first receiving portion 262. The rod 74 perpendicularly extends from the cap 72.

In assembly of the cable management device 100, the locking member 20 is sleeved on the guide member 16. In detail, the main body 162 is received in the second receiving portion 264. The four protrusions 164 engage in the four grooves 268. Therefore, the locking member 20 cannot be rotated relative to the guide member 16, but can move along the longitudinal direction of the protrusions 164. The winding member 30 is sleeved on the sleeve 24. In detail, the sleeve 24 passes through the first receiving hole 38 and extends outward from the first receiving hole 38. The third surface 322 contacts the bottom board 12, and a receiving space 39 is formed between the fourth surface 324 and the bottom board 12. The pedestal 22 is received in the receiving space 39. The second surface 224 contacts the fourth surface 324, and the second sawteeth 329 mesh with the first sawteeth 229. The height of the receiving space 39 is greater than the thickness of the pedestal 22, so that the pedestal 22 can move up and down in the receiving space 39. The driving member 40 is sleeved on the top end 242 of the sleeve 24 that extends out of the first receiving hole 38, and sits on the winding member 30. In detail, the sleeve 24 is inserted into the second receiving hole 426. The lower surface 422 faces the fifth surface 342, and the third sawteeth 349 mesh with the fourth sawteeth 48. The outer barrel 44 rests on a top surface 140 of the side wall 14. The spring 50 is sleeved on the sleeve 24 and is received in the inner barrel 46. The pressing member 60 is fixedly connected to the top end 242 via the external threads 244 engaging with the internal threads 622.

In this situation, the lower end 54 of the spring 50 contacts the upper surface 424 of the plate 42, and the upper end 52 of the spring 50 contacts the pressing member 60. The spring 50 is compressed and applies a force to the pressing member 60 to make the first sawteeth 229 mesh with the second sawteeth 329 in an initial state of the cable management device 100. In this embodiment, the pressing member 60 seals the space between the sleeve 24 and the inner barrel 46 and thus dust and other impurities are kept out. The rod 74 engages in the blocking hole 168, and the cap 72 abuts against the engagement surface 266 and a top surface of the guide member 16. In the cable management device 100, the ring-shaped groove 47 supplies a space for an installation tool during assembling of the cable management device 100. The knurls 444 increase friction force when a user or a tool rotates the driving member 40. The blocking member 70 locks the various elements including the base 10, the locking member 20, the winding member 30, the driving member 40, the spring 50, and the pressing member 60 together, and restricts the range of movement of the locking member 20 along the guide member 16.

In the initial state of the cable management device 100, the third sawteeth 349 mesh with the fourth sawteeth 48, and the spring 50 is compressed and applies a force to the pressing member 60 to make the first sawteeth 229 mesh with the second sawteeth 329. A user grips the knurls 444, and the driving member 40 is rotated with the winding member 30 along the second direction, to wind the cable 90 around the winding portion 36. However, the cable 90 cannot be drawn by the user to the outside of the cable management device 100 along the first direction because of the meshing of the first sawteeth 229 and the second sawteeth 329. Then when a downward pressing force is applied to the pressing member 60 by the user, the locking member 20 moves down to separate the first sawteeth 229 from the second sawteeth 329. In this situation, the winding member 30 can be rotated freely. Therefore, the cable 90 can be drawn by the user to the outside of the cable management device 100 along the first direction. When the pressing force is released, the spring 50 lifts the pressing member 60, and the first sawteeth 229 again mesh with the second sawteeth 329. During winding of the cable 90, the first sawteeth 229 are separated from the second sawteeth 329. That is, the locking member 20 does not block the rotation of the winding member 30. Therefore, it is convenient to wind and to unwind the cable 90.

The cable management device 100 can be easily assembled and disassembled due to its simple configuration. Furthermore, the cable management device 100 can be repeatedly used, and so can reduce costs.

Although numerous characteristics and advantages of the present embodiments have been set forth in the foregoing description, together with details of the structures and functions of the embodiments, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A cable management device comprising:

a base comprising a bottom board, a guide member perpendicularly extending from a central portion of the bottom board, and a plurality of protrusions formed on the guide member;

a locking member comprising a pedestal, a sleeve perpendicularly extending from a central portion of the pedestal, and a stepped hole defined axially passing through the sleeve and the pedestal, wherein the stepped hole comprises a first receiving portion and a second receiving portion, a plurality of grooves are defined in an inner wall of the sleeve at the second receiving portion, a first surface and a second surface are defined on opposite sides of the pedestal, the grooves slidably receive the protrusions, the first surface faces the bottom board, and a plurality of first sawteeth are formed on the second surface;

a winding member comprising a first end, a second end, a winding portion positioned between the first end and the second end, and a first receiving hole axially defined and passing through the first end, the winding portion and the second end, wherein the first receiving hole has the sleeve moveably received therein, the first end comprises a third surface and a fourth surface, the fourth surface surrounds the first receiving hole and is generally surrounded by the third surface, the third surface contacts the bottom board, a plurality of second sawteeth are formed on the fourth surface, a receiving space is formed between the fourth surface and the bottom board, a height of the receiving space is greater than a thickness of the pedestal, the pedestal is movably received in the receiving space, and the second end comprises a fifth surface on which a plurality of third sawteeth are formed;

a driving member comprising a plate and a number a plurality of fourth sawteeth, wherein the plate comprises a lower surface and an upper surface positioned at opposite sides thereof, a second receiving hole is axially defined in a central portion of the plate and extends from the lower surface to the upper surface, and the fourth sawteeth are formed on the lower surface;

a pressing member connected to a top end of the sleeve, wherein the top end of the sleeve is away from the pedestal; and a spring sleeved on the sleeve and compressed between the pressing member and the driving member.

2. The cable management device of claim 1, wherein the guide member comprises a main body which is substantially a cylindrical rod with a circumferential surface, and the protrusions extend from the circumferential surface and perpendicularly connect the bottom board.

3. The cable management device of claim 1, wherein the inner diameter of the first receiving portion is larger than the inner diameter of the second receiving portion, and an engagement surface is formed on an inside of the locking member at the junction of the first receiving portion and the second receiving portion.

4. The cable management device of claim 3, further comprising a blocking member, wherein a blocking hole is formed in the guide member for receiving the blocking member.

5. The cable management device of claim 4, wherein the blocking member comprises a cap and a rod, a diameter of the cap is larger than the inner diameter of the second receiving portion but less than the inner diameter of the first receiving portion, and the rod is engaged in the blocking hole with the cap abutting against the engagement surface and a top end of the guide member.

6. The cable management device of claim 3, wherein the grooves pass through the engagement surface and the first surface, a length of each of the grooves is equal to a depth of the second receiving portion, and a depth of each of the grooves is less than or equal to the difference between the radius of the first receiving portion and the radius of the second receiving portion.

7. The cable management device of claim 6, wherein a length of each of the protrusions is larger than the length of each of the grooves, and the locking member can move along a longitudinal direction of the protrusions.

8. The cable management device of claim 1, wherein the base further comprises a peripheral side wall perpendicularly extending from and surrounding the bottom board, and two through holes allowing a cable to pass through are defined in the side wall.

9. The cable management device of claim 1, wherein the first end, the winding portion, and the second end cooperatively form a winding space.

10. The cable management device of claim 9, wherein a hook is formed on the winding portion and positioned in the winding space, and an opening which can expose the hook is formed on the side wall.

11. The cable management device of claim 1, wherein the driving member further comprises an outer barrel with an outer side surface, the outer barrel perpendicularly extends from the upper surface and surrounds the second receiving hole, and a number of knurls are formed on the outer side surface.

12. The cable management device of claim 11, wherein the driving member further comprises an inner barrel received in the outer barrel and surrounding the second receiving hole, and the outer barrel, the inner barrel and the plate cooperatively form a ring-shaped groove.

13. The cable management device of claim 1, wherein external threads are formed surrounding the top end of the sleeve, a threaded hole with internal threads is axially defined in a central portion of the pressing member, the pressing member is connected to the top end of the sleeve, and the internal threads engage with the external threads.

14. The cable management device of claim 1, wherein the first sawteeth mesh with the second sawteeth, the third sawteeth mesh with the fourth sawteeth, the first sawteeth, the second sawteeth, the third sawteeth, and the fourth sawteeth are all tilted, the first sawteeth and the third sawteeth are tilted in two contrary directions, and the second sawteeth and the fourth sawteeth are tilted in two contrary directions.

* * * * *